US007217098B2

(12) United States Patent
Lim

(10) Patent No.: US 7,217,098 B2
(45) Date of Patent: May 15, 2007

(54) TOWER FAN ASSEMBLY

(75) Inventor: Gary M. Lim, Palos Verdes Peninsula, CA (US)

(73) Assignee: Seville Classics, Inc., Los Angeles, CA (US)

( * ) Notice: Subject to any disclaimer, the term of this patent is extended or adjusted under 35 U.S.C. 154(b) by 158 days.

(21) Appl. No.: 10/812,774

(22) Filed: Mar. 29, 2004

(65) Prior Publication Data

US 2005/0123391 A1 Jun. 9, 2005

Related U.S. Application Data

(63) Continuation-in-part of application No. 10/727,748, filed on Dec. 3, 2003, now Pat. No. 6,953,322.

(51) Int. Cl.
*F04D 29/36* (2006.01)

(52) U.S. Cl. ..... 416/100; 416/244 R

(58) Field of Classification Search ..... 416/100, 416/79, 82, 98, 112, 116, 244 R
See application file for complete search history.

(56) References Cited

U.S. PATENT DOCUMENTS 4,469,084 A 9/1984 Gillotti
4,713,146 A 12/1987 Ek
RE34,334 E 8/1993 Chaney
5,266,004 A 11/1993 Tsumurai et al.
5,435,817 A 7/1995 Davis et al.
5,601,400 A 2/1997 Kondo et al.
5,984,991 A 11/1999 Glucksman
6,156,085 A 12/2000 Chiu et al.
6,344,065 B1 2/2002 Boulva
6,406,258 B1 6/2002 Lin et al.
6,491,502 B2 12/2002 Hunt
6,499,651 B2 * 12/2002 Gerrie et al. ..... 229/67.1
2003/0021682 A1 1/2003 Tseng

* cited by examiner

*Primary Examiner*—Edward K. Look
*Assistant Examiner*—Dwayne J White
(74) *Attorney, Agent, or Firm*—Raymond Sun

(57) ABSTRACT

A fan assembly has a base portion having a fixed base, a blower portion that includes an oscillating blower mount that is operably coupled to the fixed base, and a blower that is coupled to the blower mount and which oscillates when the blower mount oscillates. The assembly further includes a degree swing setting assembly that controls the degree of oscillation to be experienced by the blower mount.

17 Claims, 14 Drawing Sheets

50
66
58
72
70
84
92
69
64
61
78
62
65
63
26

TOWER FAN ASSEMBLY

RELATED CASES

This is a continuation-in-part of Ser. No. 10/727,748, filed Dec. 3, 2003, now U.S. Pat. No. 6,953,322 entitled "Tower Fan Assembly", whose entire disclosure is incorporated by this reference as though set forth fully herein.

BACKGROUND OF THE INVENTION

1. Field of the Invention

The present invention relates to a fan assembly, and in particular, to a tower fan assembly.

2. Description of the Related Art

Numerous conventional fan assemblies are readily available in the marketplace. Tower fan assemblies are particularly desirable because of their ability to quickly circulate a large amount of air in a small area. Most conventional tower fans have an outer housing that oscillates together with the blower. Unfortunately, an oscillating outer housing can pose safety concerns, especially to children and pets.

Another drawback that is frequently experienced by conventional tower fan assemblies is that the oscillating blower and outer housing wobbles because almost the entire fan assembly sits on a single shaft which functions to oscillate the blower and outer housing. A wobbling fan assembly is not stable.

Thus, there still remains a need for a tower fan assembly that overcomes the above drawbacks.

SUMMARY OF THE INVENTION

It is an objective of the present invention to provide a tower fan assembly where the outer housing is stationary.

It is another objective of the present invention to provide a tower fan assembly which provides improved stability during operation and use.

It is yet another objective of the present invention to provide a smooth glide mechanism for the blower in a tower fan assembly.

It is a further objective of the present invention to provide a tower fan assembly where the extent and degree of the oscillation of the fan can be adjusted.

It is yet a further objective of the present invention to provide a tower fan assembly which has an improved oscillation motor assembly for oscillating the fan.

The objectives of the present invention can be accomplished by providing a fan assembly that has a base portion that remains stationary during the operation of the fan assembly, the base portion having a stationary base support plate. The assembly also includes a blower portion that includes an oscillating top plate, a blower that is coupled to the top plate and which oscillates when the top plate oscillates, and a grill cover that is coupled to the base support plate so that the grill cover remains stationary even when the top plate and the blower oscillates. The assembly can optionally include a smooth glide mechanism positioned between the top plate and the base support plate for supporting the oscillation of the top plate about the base support plate.

In another embodiment of the present invention, a fan assembly has a base portion having a fixed base, a blower portion that includes an oscillating blower mount that is operably coupled to the fixed base, and a blower that is coupled to the blower mount and which oscillates when the blower mount oscillates. The assembly further includes a degree swing setting assembly that controls the degree of oscillation to be experienced by the blower mount.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

FIGS. 1–5 illustrate one embodiment of a tower fan assembly 10 according to the present invention. The tower fan assembly 10 has a base portion 12, a blower portion 14 and a control portion 16.

Figure 2:
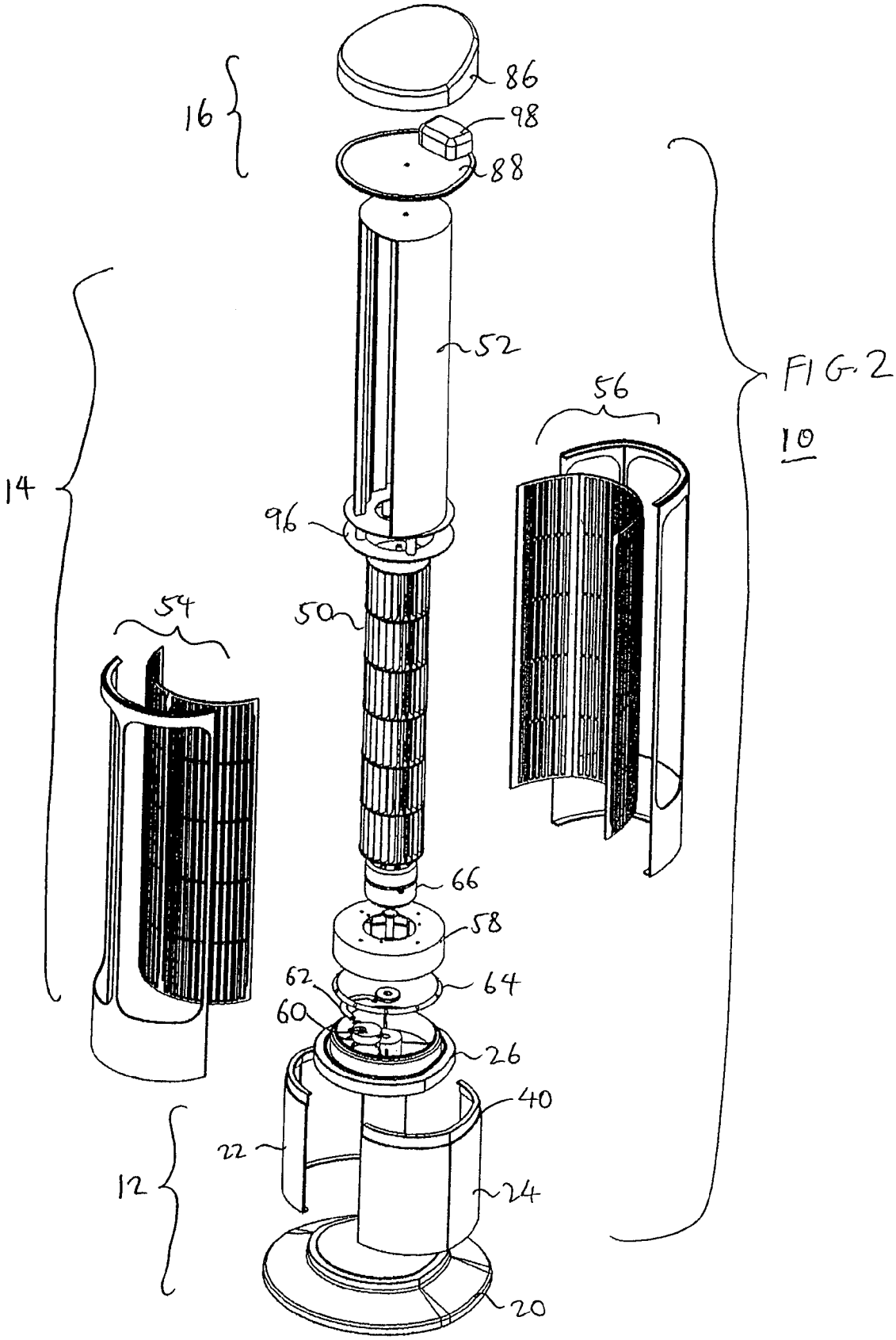
FIG. 2 is an exploded perspective view of the assembly of FIG. 1.
Figure 5:
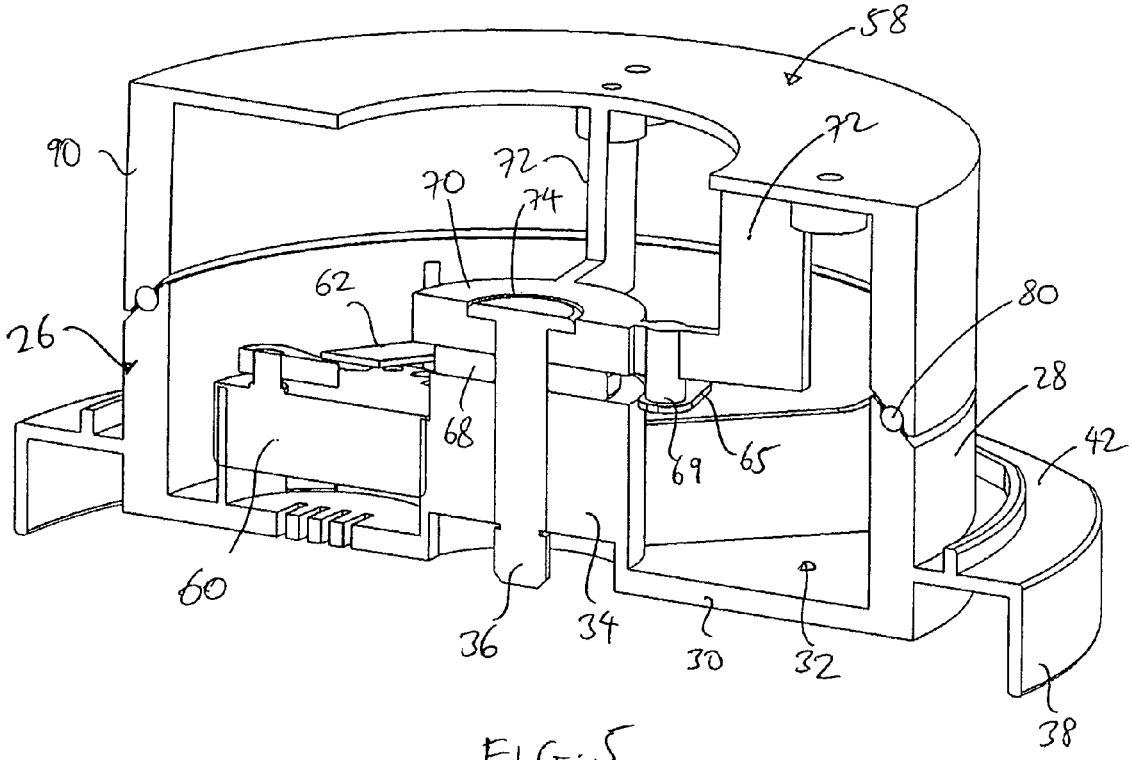
FIG. 5 is a cross-sectional view of the components in FIG. 3.

Referring to FIGS. 2 and 5, the base portion 12 is stationary, and has a base plate 20, a base support that is made up of a left shell 22 and a right shell 24, and a fixed and stationary base support plate 26. The base support plate 26 has an annular wall 28 extending upwardly from a bottom wall 30 to define an accommodation space 32 that houses the components of the oscillation assembly for the blower (described below). A central mount 34 extends upwardly from the bottom wall 30 at the center of the accommodation space 32. A bore extends through the mount 34, and a mounting shaft 36 extends through the bore. An annular flange 38 extends from the annular wall 28, with the flange 38 adapted to be seated on the shoulder 40 of the shells 22 and 24. The flange 38 itself defines an annular shoulder 42.

Figure 1:
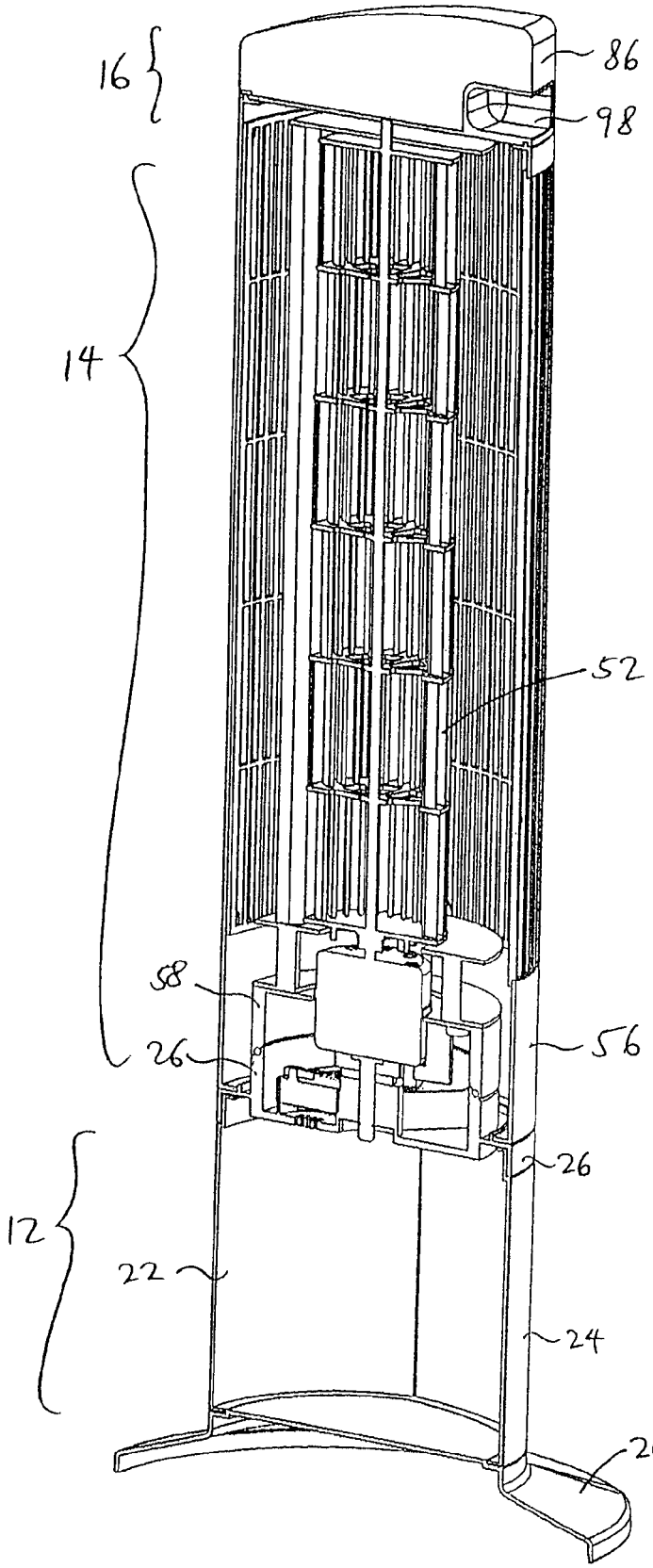
FIG. 1 is a cross-sectional perspective view of a tower fan assembly according to one embodiment of the present invention.

Referring to FIGS. 2–5, the blower portion 14 includes a blower 50, a blower housing 52, a grill cover that includes two separate grill shells 54 and 56, and an oscillation assembly. The blower 50 has a plurality of blades 51, and is driven by a blower motor 66. The blower 50 is retained inside the blower housing 52, which is in turn retained inside the grill shells 54 and 56. A base ring 96 is provided at the bottom of the blower housing 52. The bottom edges of the grill shells 54, 56 are adapted to be supported on the shoulder 42 of the base support plate 26, as best shown in FIG. 1. For example, the bottom edges of the grill shells 54, 56 can be fixedly secured to the base support plate 26 by screws or other similar attachment mechanisms.

Figure 3:
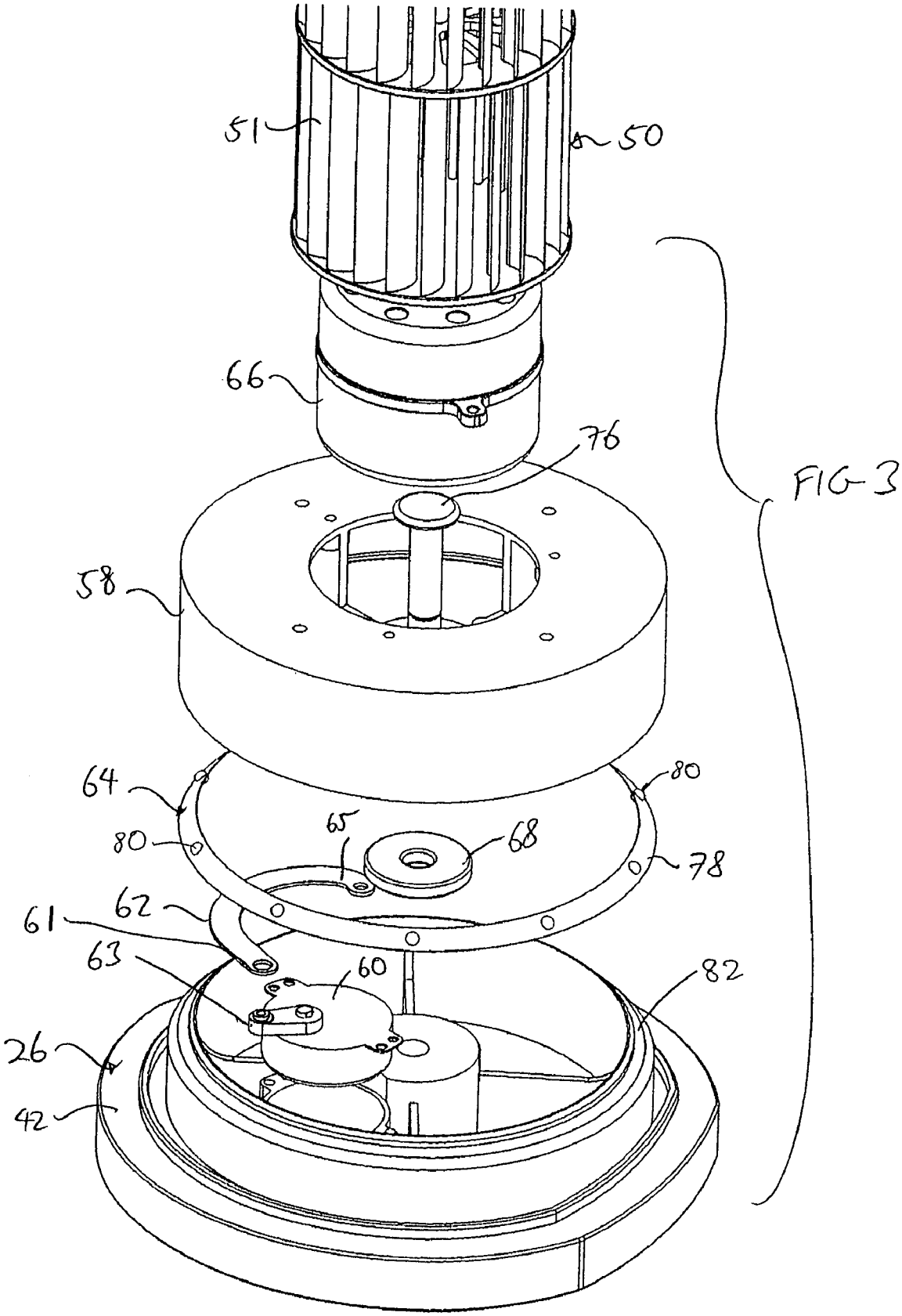
FIG. 3 is an enlarged, exploded top perspective view of certain components of the assembly of FIG. 1.
Figure 4:
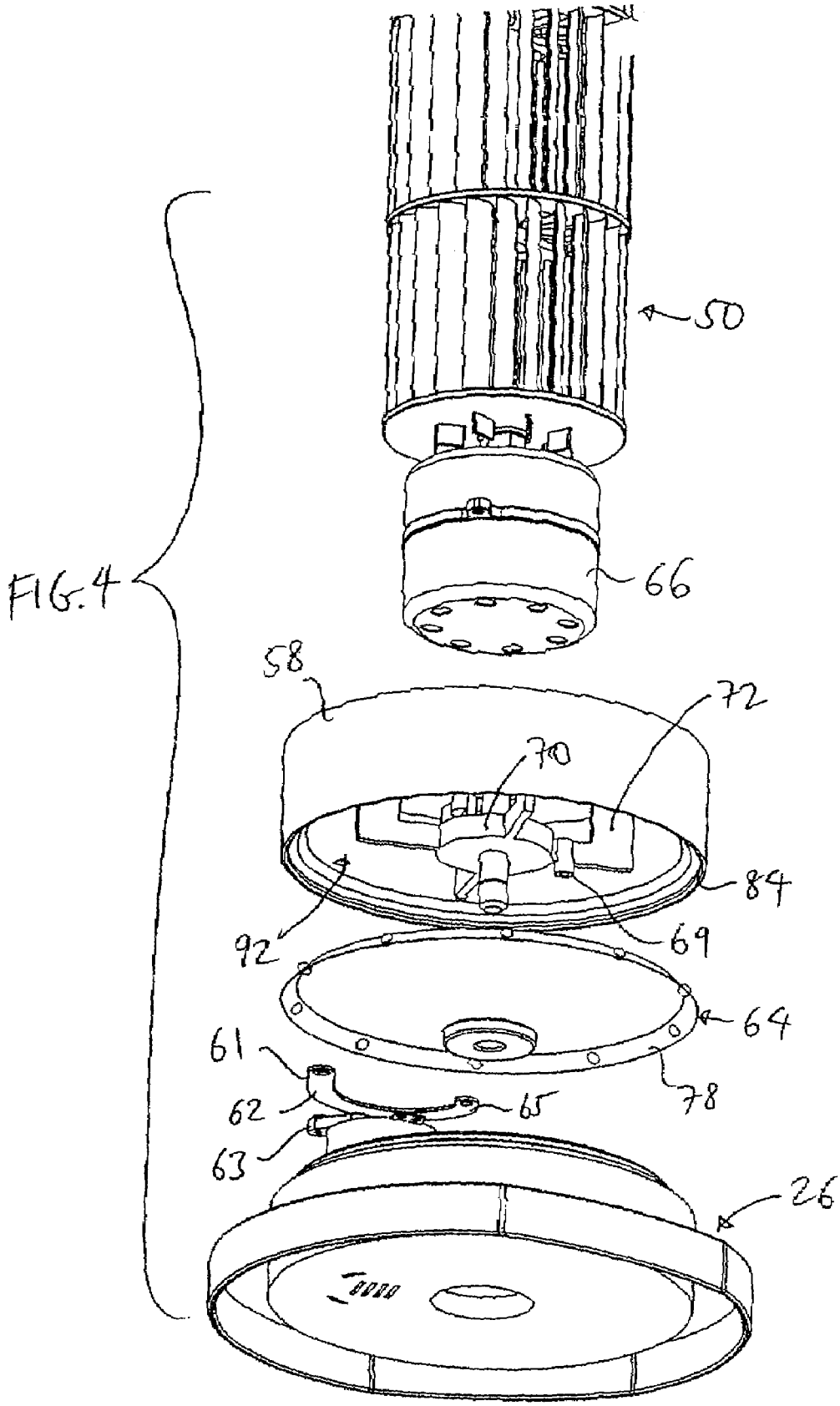
FIG. 4 is an enlarged, exploded bottom perspective view of the components in FIG. 3.

The oscillation assembly is also retained inside the grill shells 54 and 56, and includes an oscillating top plate 58 on which the base ring 96 of the blower housing 52 is mounted, an oscillation motor 60 that is secured to the bottom wall 30 inside the accommodation space 32, and an oscillating link arm 62 having one end 61 coupled to a crank 63 of the motor 60 and another end 65 coupled to a pivot pin 69 that extends from an arm 72 adjacent a support piece 70 (see FIGS. 3–5). The oscillating top plate 58 has an annular wall 90 that defines an internal space 92. A spacer grease bushing 68 can be positioned between the top of the mount 34 and a support piece 70 that is suspended from the top plate 58 by four arms 72. The support piece 70 and its four arms 72 are retained inside the internal space 92. The support piece 70 has a bore through which the mounting shaft 36 extends, and has a depression 74 at its top surface for receiving the enlarged top end 76 of the mounting shaft 36. The spacer grease bushing 68 also has an opening through which the mounting shaft 36 extends. Thus, the mounting shaft 36 is retained by the support piece 70 and extends through the spacer grease bushing 68 and the mount 34 of the base support plate 26 to function as a oscillation axis for the oscillating top plate 58 to oscillate about the fixed base support plate 26. In addition, the blower motor 66 can be secured (e.g., by screws) to the top plate 58.

The oscillation assembly can optionally include a smooth glide mechanism 64 which facilitates smoother oscillation of the oscillating top plate 58 with respect to the fixed base support plate 26. The smooth glide mechanism 64 can be embodied in the form of a retainer ring 78 that retains a plurality of spaced apart ball bearings 80. An annular ball bearing track 82 is provided along the top edge of the annular wall 28 of the fixed base support plate 26, and a corresponding annular ball bearing track 84 is provided along the bottom edge of the annular wall 90 of the oscillating top plate 58, with the bearings 80 seated between the tracks 82 and 84. Thus, the bearings 80 help to improve the sliding oscillation movement of the annular wall 90 of the oscillating top plate 58 as it oscillates with respect to the fixed annular wall 28 of the base support plate 26.

The control portion 16 includes a control panel 86 secured to a control panel base plate 88. The control panel 86 includes the switches and other control buttons for operating the tower fan assembly 10. The control panel base plate 88 is mounted on the top of the shells 54 and 56 by screws or similar attachment mechanisms. A hollowed handle 98 can be formed on the control panel base plate 88 to allow a user to insert his or her fingers inside the hollowed space for gripping the assembly 10.

In operation, the user turns on the motor 60, which will cause the crank 63 to rotate. Since the crank 63 is coupled to the link arm 62, rotation of the crank 63 will cause the link arm 62 to oscillate in a reciprocating back and forth motion. Since the link arm 62 is also coupled to the top plate 58 (via the pin 69 and an arm 72), oscillation of the link arm 62 will cause the top plate 58 to oscillate about the axis defined by the mounting shaft 36. Since the blower 50 is coupled (via the blower housing 52) to the top plate 58, the oscillation of the top plate 58 will likewise cause the blower 50 to oscillate as it blows out air. However, since the grill shells 54 and 56 are fixedly connected to the fixed base support plate 26 (via the shoulder 42), the grill shells 54 and 56 do not oscillate and remain stationary at all times.

Thus, the tower fan assembly 10 of the present invention provides a grill cover (i.e., shells 54, 56) that acts as an outer housing that remains stationary at all times even while the blower 50 housed therein is being oscillated. In addition, the smooth glide mechanism 64 allows the top plate 58 to be oscillated about the fixed base support plate 26 in a smooth manner which reduces friction, and wear and tear, thereby increasing the life and effectiveness of the oscillating blower 50. Also, the smooth glide mechanism 64 improves the balance and stability of the oscillating top plate 58 and the blower 50 because the oscillating top plate 58 and blower 50 are now supported (via the smooth glide mechanism 64) on the stationary base support plate 26, instead of being supported on a single shaft.

FIGS. 6–14 illustrate another embodiment of a tower fan assembly 110 according to the present invention. The tower fan assembly 110 has a base portion (not shown), a blower portion 114 and a control portion 116 that can be the same as the control portion 16 described above.

Figure 9:
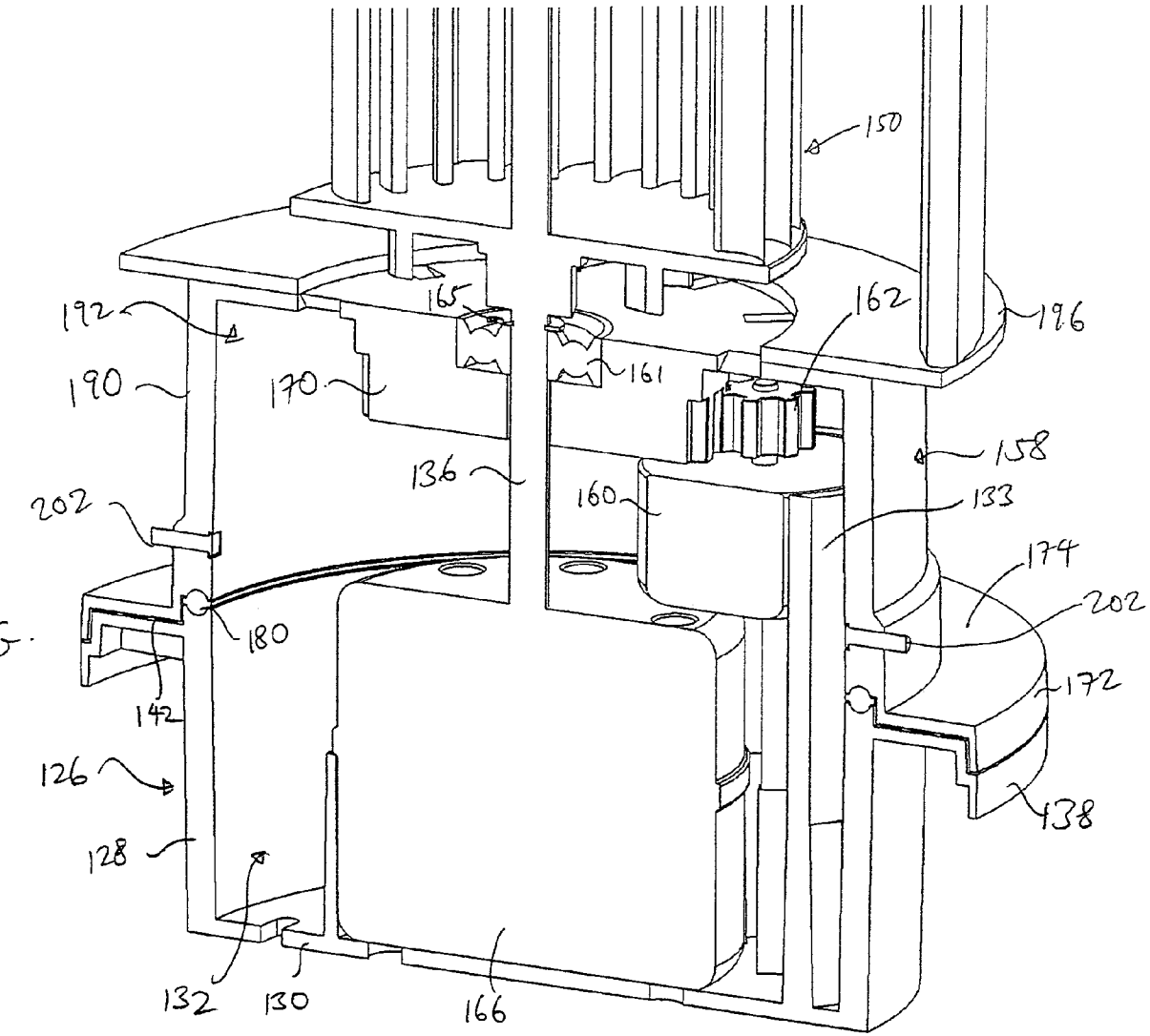
FIGS. 9 and 10 are different side cross-sectional views of some of the components of the assembly of FIG. 6.
Figure 10:
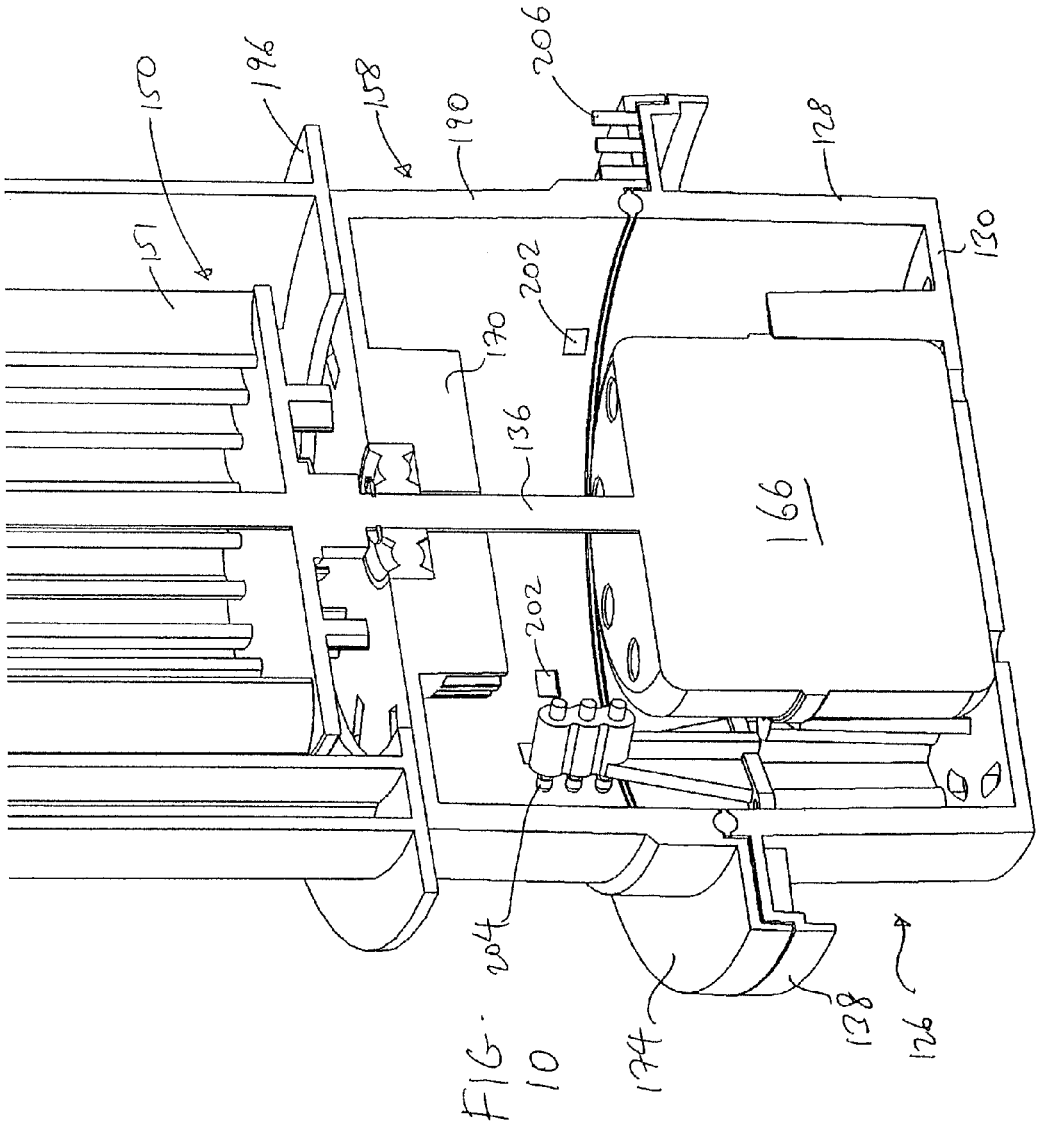
Figure 11:
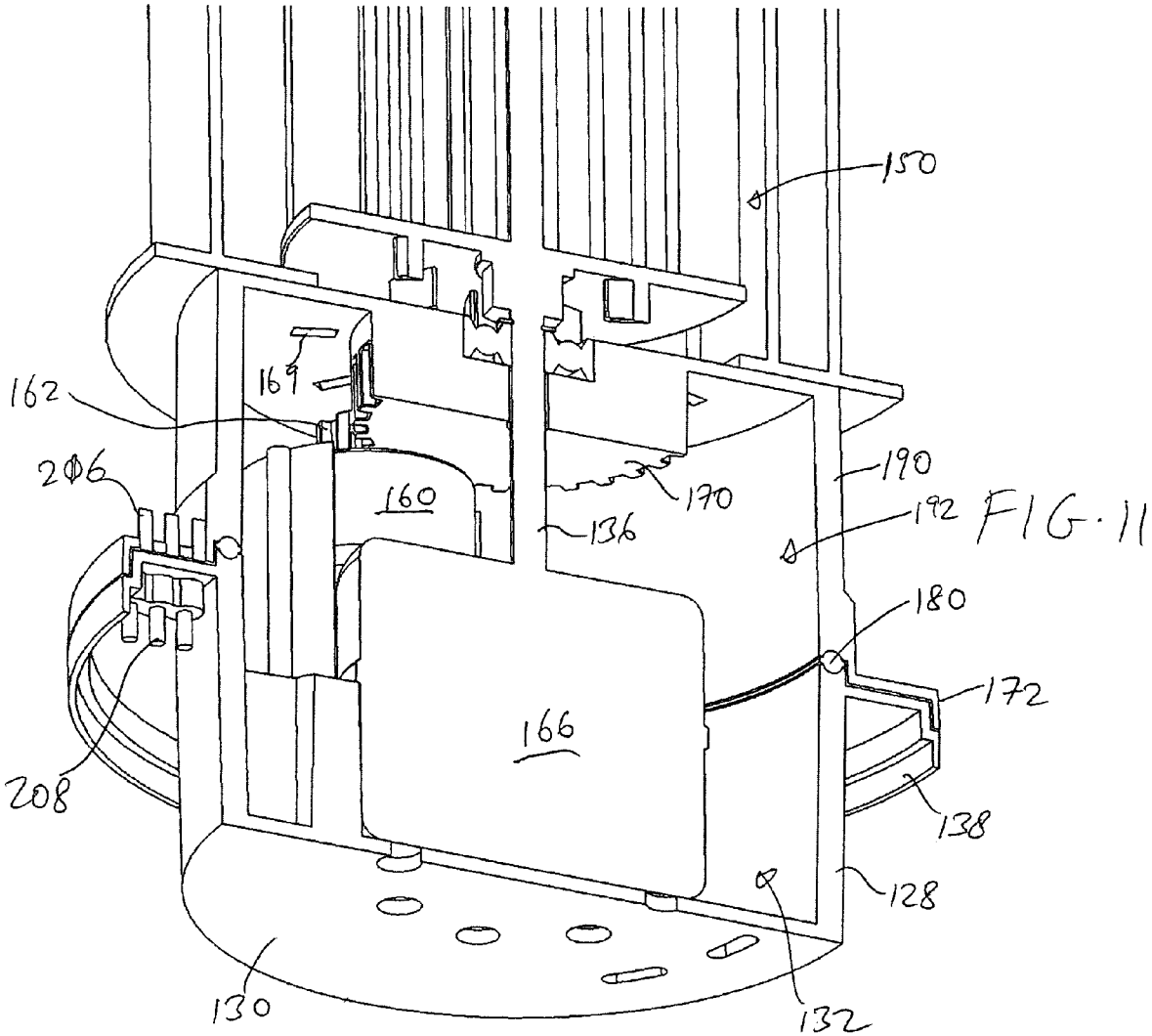
FIGS. 11 and 12 are different bottom perspective cross-sectional views of some of the components of the assembly of FIG. 6.
Figure 12:
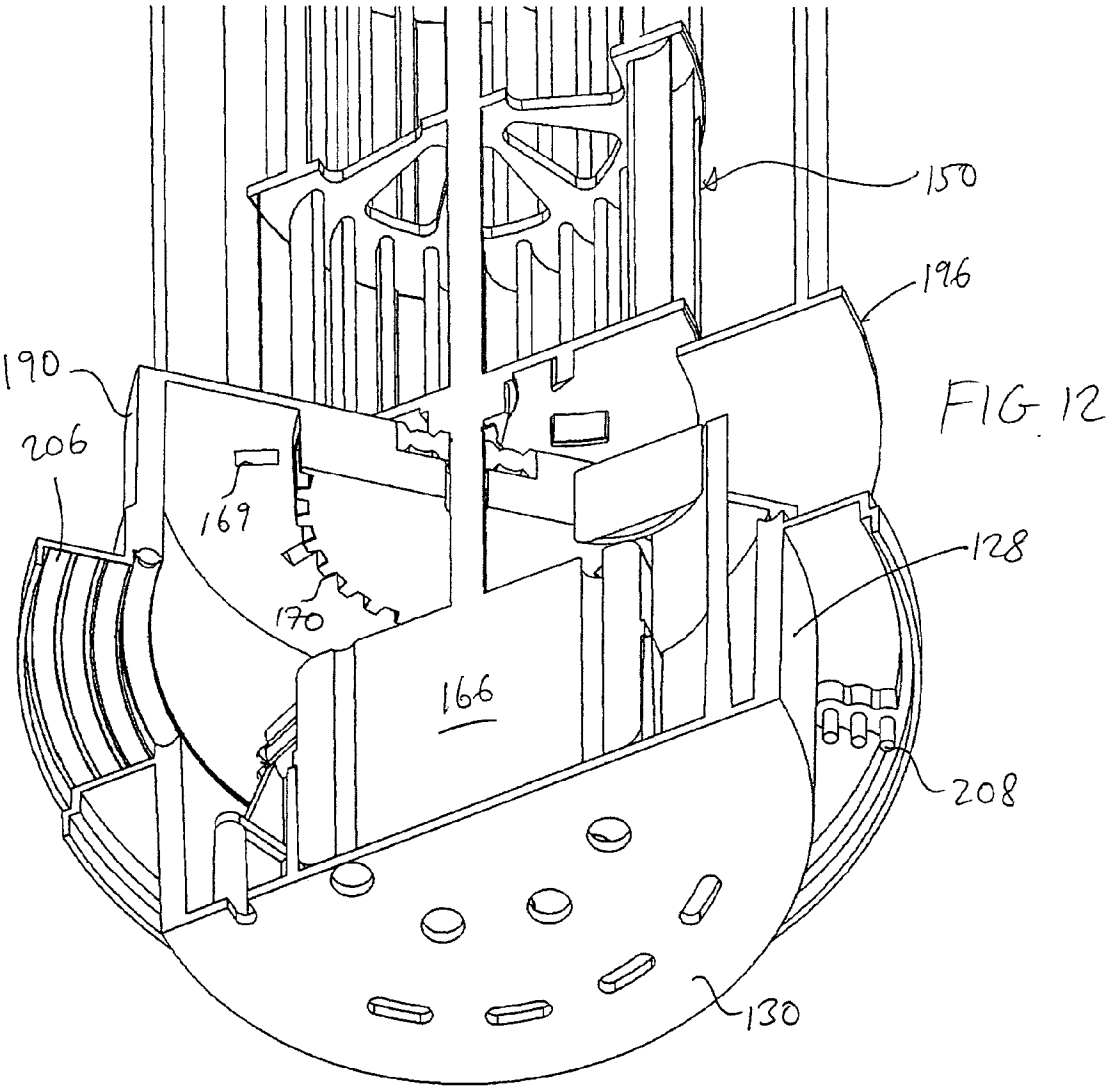

Referring to FIGS. 9–11, the base portion is similar to the base portion 12 described above, except that it has a fixed base 126 instead of the base support plate 26 in FIGS. 1–5. The fixed base 126 has an annular wall 128 extending upwardly from a bottom wall 130 to define an accommodation space 132 that houses the components of the oscillation assembly for the blower and a blower motor 166 (described below). An annular flange 138 extends from the annular wall 128 and defines an annular shoulder 142.

Figure 6:
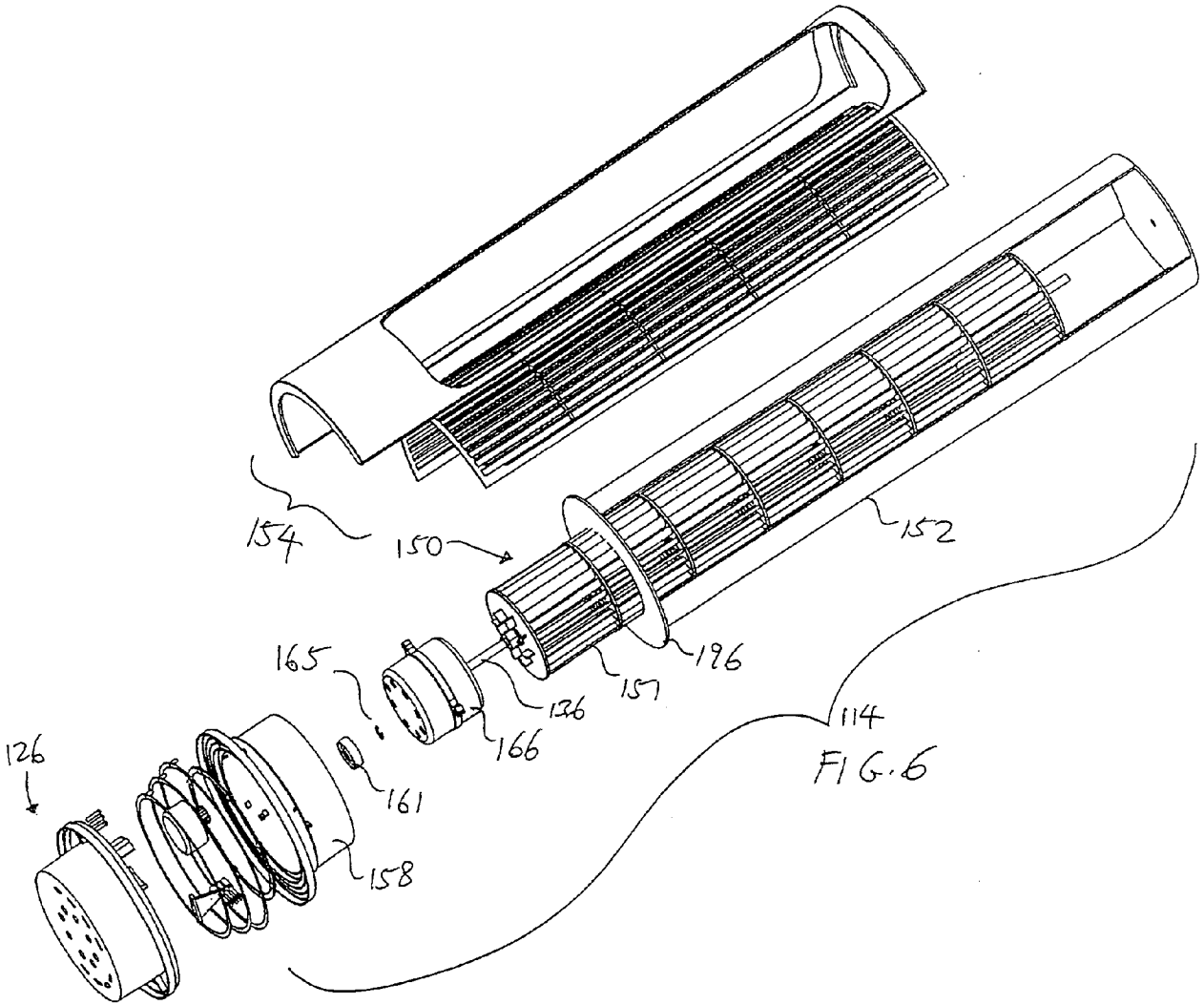
FIG. 6 is an exploded perspective view of a tower fan assembly according to another embodiment of the present invention.

Referring to FIGS. 6–13, the blower portion 114 includes a blower 150, a blower housing 152, an oscillation assembly, and a grill cover that includes two separate grill shells 154. Only one grill shell 154 is shown in FIG. 6, but the other grill shell can be the same as grill shell 56 or 154. The blower 150 has a plurality of blades 151, and is driven by a blower motor 166 via a shaft 136 that extends from the top of the blower motor 166. The blower 150 is retained inside the blower housing 152, which is in turn retained inside the grill shells 154. A base ring 196 is provided at the bottom of the blower housing 152.

The oscillation assembly is also retained inside the grill shells 154, and includes an oscillating blower mount 158 on which the base ring 196 of the blower housing 152 is mounted, and a forward/reverse oscillation motor 160 that is retained inside the accommodation space 132. The oscillation motor 160 is retained in a fixed location inside the accomodation space 132 by guide walls 133 that are secured to the bottom wall 130. The oscillating blower mount 158 has an annular wall 190 that defines an internal space 192. The blower motor 166 is secured to the bottom wall 130, and can also be secured (e.g., by screws) to the top plate 168 of the blower mount 158. Air intake vents 169 can be provided on the top plate 168 to vent hot air from inside the accomodation spaces 132 and 192, which together form a singular accomodation space.

An annular flange 172 extends from the annular wall 190 of the blower mount 158, with the flange 172 adapted to be seated on the shoulder 142 of the fixed base 126. The flange 172 itself defines an annular shoulder 174. The bottom edges of the grill shells 154 can be fixedly secured to either the shoulder 174 or the flange 138, depending on whether the manufacturer wishes the grill shells 154 to oscillate together with the oscillating blower 150. For example, the grill shells 154 will oscillate together with the blower 150 if the bottom edges of the grill shells 54 are fixedly secured to the shoulder 174, the flange 172, or the annular wall 190 of the oscillating blower mount 158. On the other hand, the grill shells 154 will not oscillate with the blower 150 if the bottom edges of the grill shells 54 are fixedly secured to the flange 138 of the fixed base 126.

A blower mount bearing 161 is seated in a recess 163 provided in the top plate 168. A collar lock 165 is positioned above the blower mount bearing 161. The shaft 136 of the blower motor 166 extends through the recess 163, the blower mount bearing 161, and the collar lock 165. The collar lock 165 functions to retain the shaft 136 and the blower mount bearing 161 in the recess 163.

A blower mount gear 170 is retained inside the internal space 192 and secured (e.g., by molding) to the bottom of the top plate 168 of the blower mount 158. An oscillation motor gear 162 is mounted on the top of the oscillation motor 160, and is engagably coupled to the blower mount gear 170 so that oscillation or turning of the oscillation motor gear 162 will cause the blower mount gear 170 to oscillate or turn as well. Thus, when the oscillation motor 160 is turned on, the oscillation motor gear 162 will oscillate in its rotation, causing the blower mount gear 170 that engages it to oscillate about the oscillation motor gear 162. As the blower mount gear 170 oscillates, the blower mount 158 that is secured thereto will oscillate as well, resulting in the oscillation of the blower 150 and the blower housing 152.

The present invention provides a degree swing setting assembly that allows for the degree of oscillation of the blower mount 158 to be selected and controlled by a user. The swing setting assembly includes a plurality of sets of degree swing sensors 202, a plurality of spring-loaded power sensors 204, a plurality of power supply contact rings 206, and a plurality of spring-loaded power supply contact switches 208.

Specifically, referring to FIGS. 7–14, a plurality of sets of degree swing sensors 202 are provided in spaced-apart manner along the annular wall 190 to sense the degree of rotation of the blower 150. These degree swing sensors 203 are carried by the oscillating blower mount 158, and therefore oscillate together with the blower mount 158. Each set of sensors 202 has two sensors 202 that define the left and right limits of the desired degree swing. Any number of sets of degree swing sensors 202 can be provided. For example, if six degree sensors 202 are provided, the user will be able to select three different degree swing settings. The user can select the desired limits of oscillation of the blower 150 by pressing the appropriate button 125 on the top of the control panel 116 (see FIG. 14). A plurality of buttons 125 are provided on the control panel 116, each allowing the user to select a different degree swing. Any number of degree swings can be provided, including 45 degrees, 90 degrees, 135 degrees, 180 degrees, etc. Therefore, the two sensors for the 45 degree swing will be spaced apart along the internal surface of the annular wall 190 by about 45 degrees, the two sensors for the 90 degree swing will be spaced apart along the internal surface of the annular wall 190 by about 90 degrees (and further apart from each other than the sensors for the 45 degree swing), and so on.

A plurality of spring-loaded power sensors 204 is positioned inside the accomodation spaces 132 and 192, and is secured to the bottom wall 130 via a sensor mount 210 that is fixedly secured (e.g., by screws) to the bottom wall 130. Thus, the power sensors 204 do not oscillate. One of a plurality of wires (not shown) electrically couples each button 125 to a corresponding power sensor 204. When a particular button 125 is activated, the corresponding power sensor 204 is turned on, with the other power sensors 204 remaining in a dormant or "off" mode.

Figure 13:
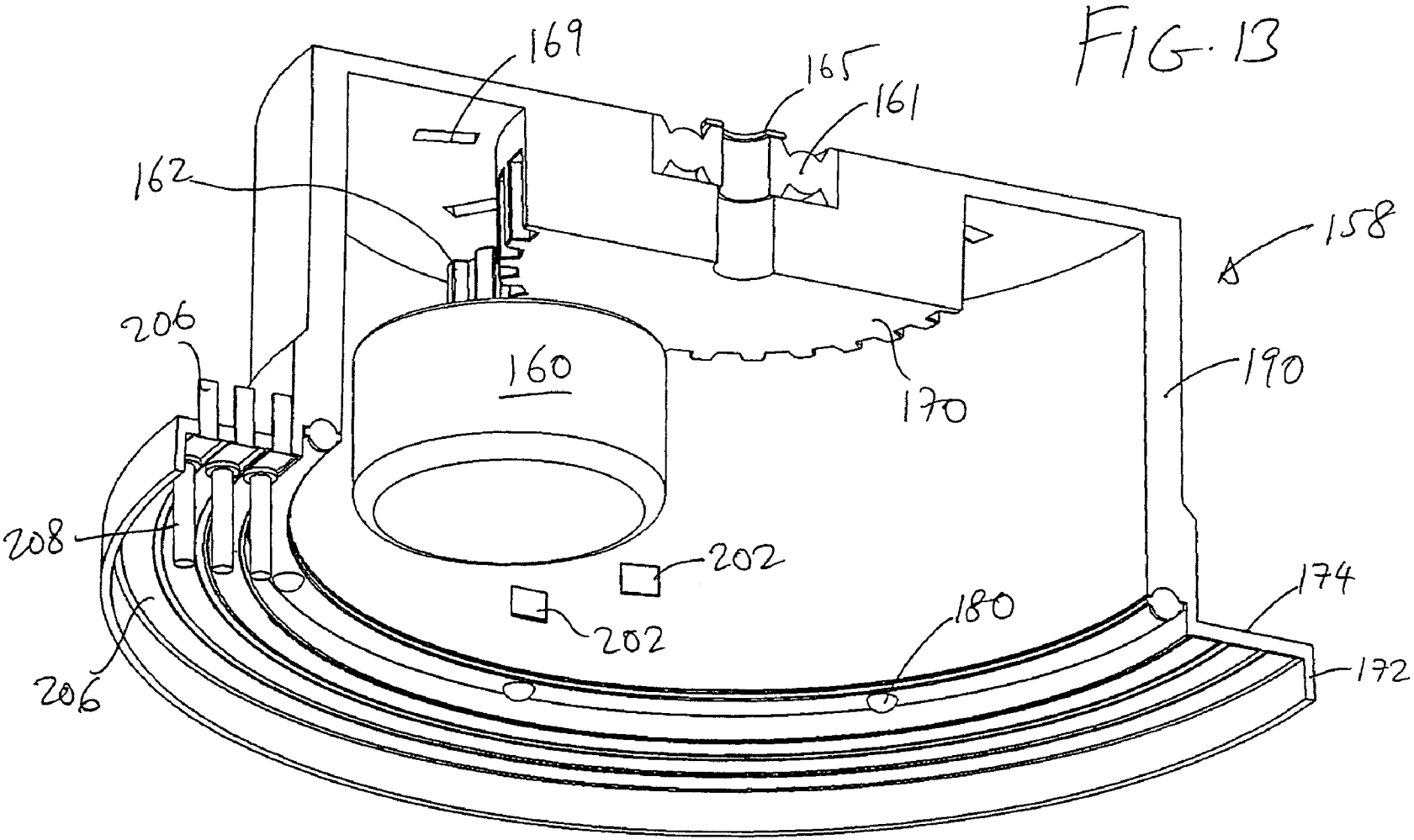
FIG. 13 is a bottom perspective cross-sectional view of the blower mount of FIG. 6.
Figure 14:
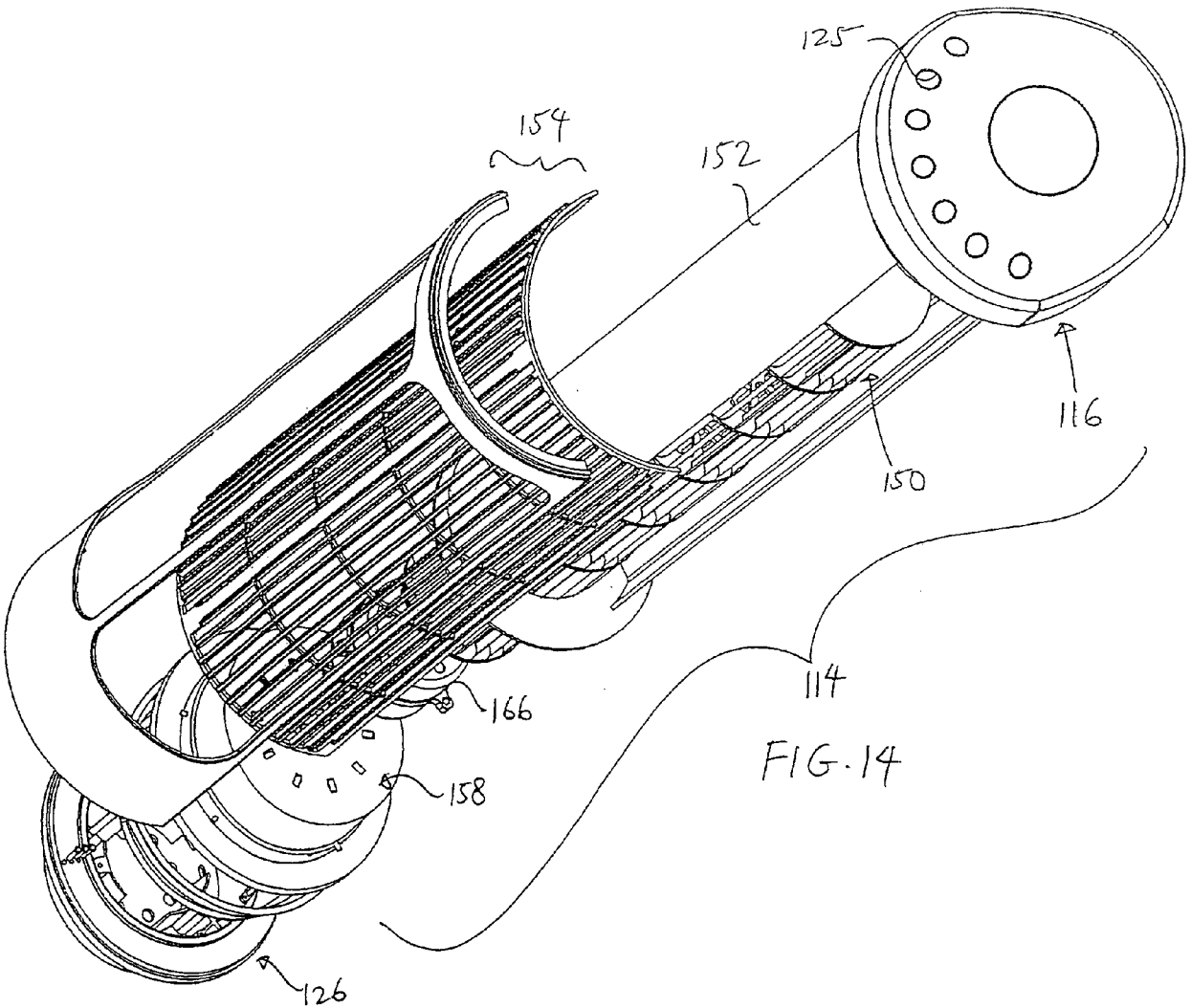
FIG. 14 is an exploded top perspective view of the assembly of FIG. 6.

A plurality of flat power supply contact rings 206 are snapped in place in tracks (not shown) provided in spaced-apart manner on the bottom of the annular shoulder 174 of the blower mount 158. Thus, the contact rings 206 oscillate with the blower mount 158. Each contact ring 206 has a contact 216 extending vertically therefrom. The contact rings 206 vary in diameter so that they are nested one within the other, so that the contacts 216 are arranged side-by-side, as best shown in FIGS. 8, 11 and 13.

A plurality of power supply contact switches 208 are secured to the shoulder 142 and are part of the fixed base 126. Thus, the contact switches 208 do not oscillate. Each contact switch 208 is continuously aligned with, and electrically coupled to, a corresponding contact ring 206. One of a plurality of wires (not shown) electrically couples each contact 216 to a corresponding set of sensors 202.

When the oscillation motor 160 is turned on, the blower mount 158 will oscillate in the manner described above, but the limit of oscillation for the blower mount 158 will be defined by the set of degree swing sensors 202 selected by the user. For example, if the user selected a 90 degree swing, the motors 160 and 166 will cause the blower mount 158 (and the degree swing sensors 202 carried thereon) to turn in a forward direction until the activated power sensor 204 (i.e., the 90 degree power sensor 204) contacts a first of the two 90-degree sensors 202. When the activated sensor 204 contacts the first 90-degree sensor 202, the circuit formed by the corresponding degree swing sensor 202, power sensor 204, power supply contact ring 206, and power supply contact switch 208 will be closed. This will cause the motor 160 will reverse directions to cause the blower mount 158 to oscillate in the reverse direction until the activated sensor 204 contacts the second 90-degree sensor 202, at which time the motor 160 will again reverse the direction of the blower mount 158. The same process repeats itself until the user turns off the motor 160. As the blower mount 158 travels past other sensors 202 (e.g., the 45-degree sensors 202), the motor 160 will not change direction because the 45-degree power sensor 204 is not activated.

Figure 7:
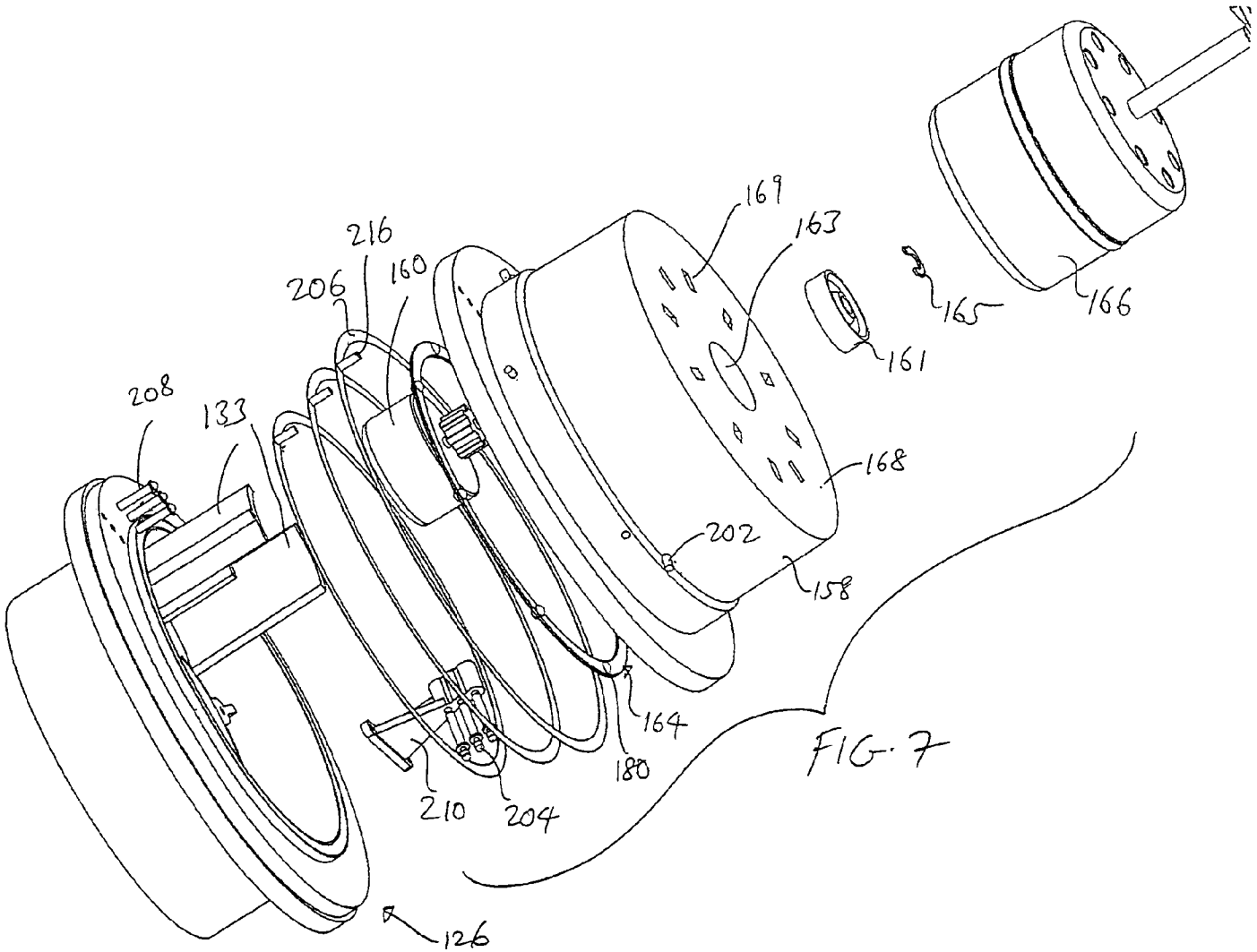
FIG. 7 is an enlarged exploded top perspective view of some of the components of the assembly of FIG. 6.
Figure 8:
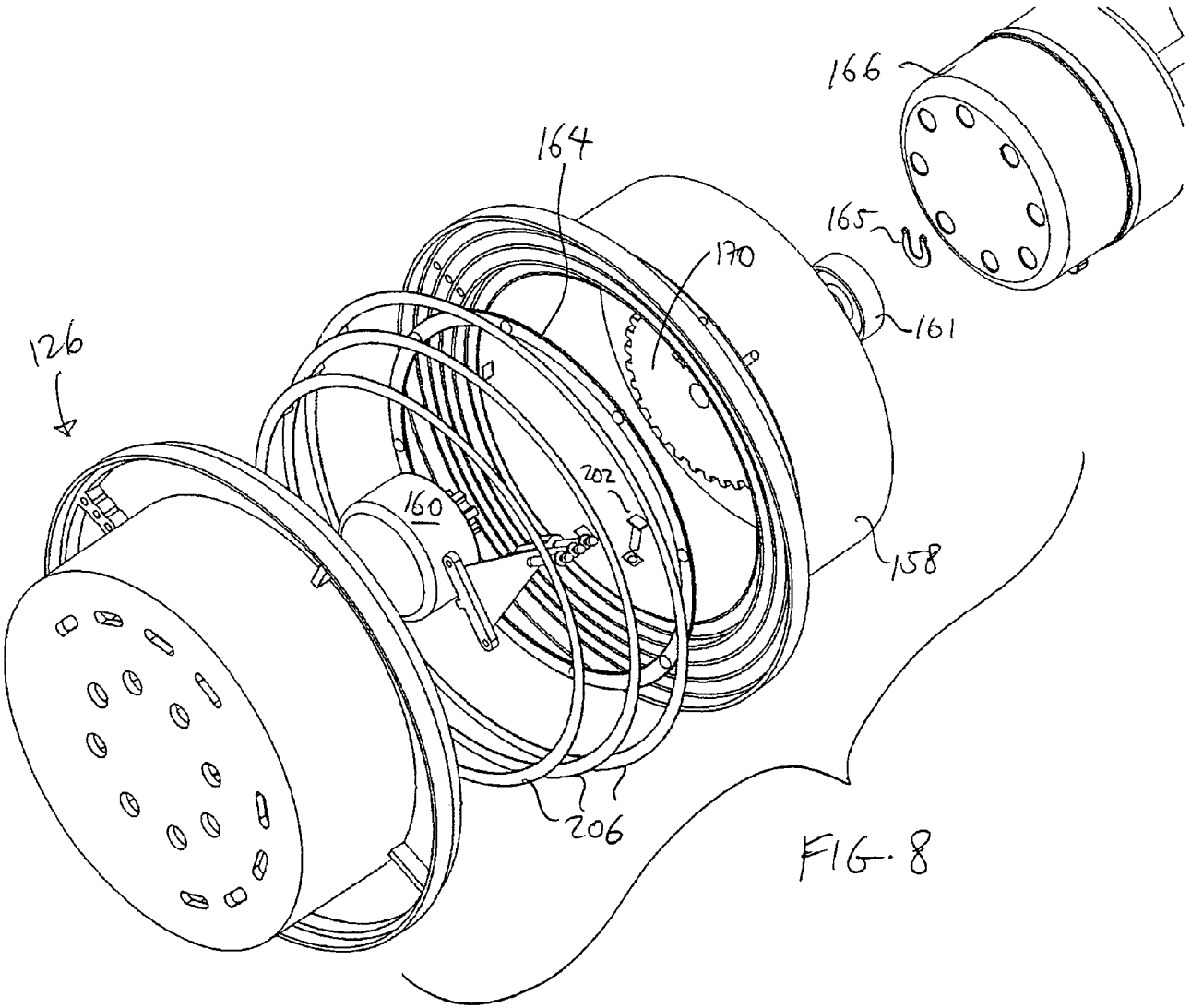
FIG. 8 is an enlarged exploded bottom perspective view of some of the components of the assembly of FIG. 6.

Referring to FIGS. 7, 8 and 11, the oscillation assembly can optionally include a smooth glide mechanism 164 which facilitates smoother oscillation of the oscillating blower mount 158 with respect to the fixed base 126. The smooth glide mechanism 164 can be the same as the smooth glide mechanism 64 described above, and include a retainer ring that retains a plurality of spaced apart ball bearings 180. Annular ball bearing tracks are provided along the top edge of the annular wall 128 of the fixed base 126 and along the bottom edge of the annular wall 190 of the oscillating blower mount 158, with the bearings 180 seated between the tracks.

In operation, the user pre-selects the desired degree swing settings by pressing the appropriate button 125, which also turns on the oscillation motor 160, which will cause the oscillation gear 162 to oscillate the blower mount gear 170. Since the blower mount gear 170 is fixedly secured to the blower mount 158, oscillation of the blower mount gear 170 will cause the blower mount 158 to oscillate to the left and to the right about the axis defined by the shaft 136. The left and right oscillation will be limited by the selected degree sensors 202 in the manner described above. If the user desires to set a different degree swing setting, the user merely presses a different button 125, and oscillation of the blower mount 158 can be continued. When the user turns off the oscillation motor 160 (e.g., by activating an OFF button on the control panel 116), the oscillation motor 160 will reset to a start position (e.g., facing the center of the fan assembly 1 10) with respect to the blower mount gear 170.

While the description above refers to particular embodiments of the present invention, it will be understood that many modifications may be made without departing from the spirit thereof. For example, the principles of the present invention can be equally applied to a heater or heating unit, or virtually any appliance that requires oscillation.

What is claimed is:

1. A fan assembly, comprising:

a base portion having a fixed base;

a blower portion that includes an oscillating blower mount that is operably coupled to the fixed base, and a blower that is coupled to the blower mount and which oscillates when the blower mount oscillates; and a degree swing setting assembly that includes:

a plurality of degree swing sensors that define the degree of oscillation to be experienced by the blower mount; and a plurality of power sensors that are normally disengaged from corresponding degree swing sensors, but which engage corresponding degree swing sensors when the oscillation direction of the blower mount is to be reversed.

2. The assembly of claim 1, wherein the fixed base is stationary, and wherein the blower portion further includes a grill cover that is coupled to the fixed base in a manner such that the grill cover remains stationary even when the blower mount and the blower oscillate.

3. The assembly of claim 1, further including a smooth glide mechanism positioned between the blower mount and the fixed base.

4. The assembly of claim 3, wherein the smooth glide mechanism includes a plurality of bearings.

5. The assembly of claim 4, wherein the bearings are spaced apart along a retainer ring.

6. The assembly of claim 1, further including:

a blower mount oscillation gear fixedly secured to the blower mount; and an oscillation motor having an oscillation motor gear that engages the blower mount oscillation gear.

7. The assembly of claim 1, further including a shaft that is coupled to the blower mount and the fixed base, and which defines an oscillation axis.

8. The assembly of claim 6, wherein the blower mount and the base define an accomodation space therebetween, with the oscillation motor and the blower mount oscillation gear housed inside the accomodation space.

9. The assembly of claim 1, wherein the degree swing setting assembly further includes:

a plurality of power supply contact rings, each power supply contact ring coupled to a corresponding degree swing sensor; and a plurality of power supply contact switches, each contact switch coupled to a corresponding power supply contact ring.

10. The assembly of claim 1, wherein the degree swing sensors are carried by the blower mount to oscillate with the blower mount.

11. The assembly of claim 1, wherein the power sensors are fixedly secured to the fixed base.

12. The assembly of claim 9, wherein the degree swing sensors are carried by the blower mount to oscillate with the blower mount.

13. The assembly of claim 12, wherein the power sensors are fixedly secured to the fixed base.

14. The assembly of claim 9, wherein the plurality of power supply contact rings are carried by the blower mount to oscillate with the blower mount.

15. The assembly of claim 14, wherein the plurality of power supply contact switches are fixedly secured to the fixed base.

16. A fan assembly, comprising:

a base portion having a fixed base;

a blower portion that includes an oscillating blower mount that is operably coupled to the fixed base, and a blower that is coupled to the blower mount and which oscillates when the blower mount oscillates; and a degree swing setting assembly that includes:

a plurality of first sensors carried by the oscillating blower mount, the first sensors defining the degree of oscillation to be experienced by the blower mount; and a plurality of second sensors fixedly secured to the fixed base, the second sensors being normally disengaged from corresponding first sensors, but which engage corresponding first sensors when the oscillation direction of the blower mount is to be reversed.

17. The assembly of claim 16, wherein the degree swing setting assembly further includes:

a plurality of power supply contact rings, each power supply contact ring coupled to a corresponding first sensor; and a plurality of power supply contact switches, each contact switch coupled to a corresponding power supply contact ring.

* * * * *